US009481434B1

(12) United States Patent
Eichinger et al.

(10) Patent No.: US 9,481,434 B1
(45) Date of Patent: Nov. 1, 2016

(54) MIDSECTION HOUSING FOR AN OUTBOARD MOTOR WITH WATER-COOLED MOUNTS

(71) Applicant: Brunswick Corporation, Lake Forest, IL (US)

(72) Inventors: Charles H. Eichinger, Oshkosh, WI (US); Bernard E. Ritger, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 15 days.

(21) Appl. No.: 14/591,493

(22) Filed: Jan. 7, 2015

(51) Int. Cl.

| | |
|---|---|
| ***B63H 20/02*** | (2006.01) |
| ***F01P 3/20*** | (2006.01) |
| ***B63H 20/00*** | (2006.01) |
| ***F01M 11/00*** | (2006.01) |
| ***B63H 20/28*** | (2006.01) |

(52) U.S. Cl.
CPC ..... *B63H 20/002* (2013.01); *B63H 20/28* (2013.01); *F01M 11/0004* (2013.01)

(58) Field of Classification Search
CPC B63H 20/002; B63H 20/28; F01M 11/0004; F01P 3/202
USPC ..... 440/88 C, 88 D, 88 G, 88 J, 88 K, 88 L
See application file for complete search history.

(56) References Cited

U.S. PATENT DOCUMENTS 5,472,360 A * 12/1995 Prasse ..... B63H 20/002 440/88 L
5,487,687 A 1/1996 Idzikowski et al.
6,416,372 B1 * 7/2002 Nozue ..... F01M 11/0004 440/88 D
7,198,530 B1 4/2007 Rothe et al.
7,896,304 B1 3/2011 Eichinger et al.
8,388,393 B1 3/2013 Eichinger et al.
8,500,501 B1 8/2013 Taylor et al.
8,540,536 B1 9/2013 Eichinger et al.
8,820,701 B1 9/2014 Eichinger

FOREIGN PATENT DOCUMENTS

JP 2012025305 A * 2/2012

OTHER PUBLICATIONS

U.S. Appl. No. 14/543,453, filed Nov. 17, 2014, Unpublished.
U.S. Appl. No. 14/543,458, filed Nov. 17, 2014, Unpublished.
(Continued)

*Primary Examiner* — Anthony Wiest
(74) *Attorney, Agent, or Firm* — Andrus Intellectual Property Law, LLP

(57) ABSTRACT

A midsection housing for an outboard motor includes a driveshaft housing having an oil sump provided therein. An adapter plate is coupled to a top of the driveshaft housing. The adapter plate has an inner surface along which oil from an engine mounted on the adapter plate drains into the oil sump. First and second pockets are formed in an outer surface of the adapter plate on first and second generally opposite sides thereof, the first and second pockets configured to receive first and second mounts therein. A water jacket is formed between the inner and outer surfaces of the adapter plate. The water jacket extends at least partway between the inner surface of the adapter plate and each of the first and second pockets, respectively. A method for cooling a mount is also provided.

17 Claims, 4 Drawing Sheets

(56) References Cited

OTHER PUBLICATIONS

Mercury Marine, photographs of adapter plate for 50 HP 4-stroke outboard motor, commercially available at least as early as 1994.

Yamaha, photograph of adapter plate for V8 F350 4-stroke outboard motor, commercially available at least as early as 2013.

* cited by examiner

MIDSECTION HOUSING FOR AN OUTBOARD MOTOR WITH WATER-COOLED MOUNTS

FIELD

The present disclosure relates to outboard motors that are mounted to a transom of a marine vessel via a transom bracket and one or more mounts. More specifically, the present disclosure relates to midsection housings for outboard motors.

BACKGROUND

U.S. Pat. No. 7,896,304, hereby incorporated herein by reference, discloses a support system for an outboard motor that uses mounts which are configured and positioned to result in an elastic center point being located closely to a roll axis of the outboard motor which is generally vertical and extends through a center of gravity of the outboard motor. The mounts are positioned so that lines which are perpendicular to their respective center lines intersect at an angle which can be generally equal to 90 degrees. The mounts are positioned in non-interfering relationship with the exhaust components of the outboard motor and its oil sump.

U.S. Pat. No. 8,500,501, hereby incorporated herein by reference, discloses an outboard marine drive that includes a cooling system drawing cooling water from a body of water in which the outboard marine drive is operating, and supplying the cooling water through cooling passages in an exhaust tube in the driveshaft housing, a catalyst housing, and an exhaust manifold, and thereafter through cooling passages in the cylinder head and the cylinder block of the engine. A 3-pass exhaust manifold is provided. A method is provided for preventing condensate formation in a cylinder head, catalyst housing, and exhaust manifold of an internal combustion engine of a powerhead in an outboard marine drive.

U.S. Pat. No. 8,540,536, hereby incorporated herein by reference, discloses a cooling system for a marine engine that has an elongated exhaust conduit comprising a first end receiving hot exhaust gas from the marine engine and a second end discharging the exhaust gas, and an elongated cooling water jacket extending adjacent to the exhaust conduit. The cooling water jacket receives raw cooling water at a location proximate to the second end of the exhaust conduit, conveys raw cooling water adjacent to the exhaust conduit to thereby cool the exhaust conduit and warm the raw cooling water, and thereafter discharges the warmed cooling water to cool the internal combustion engine.

U.S. Pat. No. 8,820,701, hereby incorporated herein by reference, discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different second angle to the horizontal and vertical directions. A method is for making the mounting arrangement.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure includes a midsection housing for an outboard motor. The midsection housing comprises a driveshaft housing having an oil sump provided therein. It also includes an adapter plate coupled to a top of the driveshaft housing. The adapter plate has an inner surface along which oil from an engine mounted on the adapter plate drains into the oil sump. First and second pockets are formed in an outer surface of the adapter plate on first and second generally opposite sides thereof, the first and second pockets configured to receive first and second mounts therein. A water jacket is formed between the inner and outer surfaces of the adapter plate. The water jacket extends at least partway between the inner surface of the adapter plate and each of the first and second pockets, respectively.

Another example of the present disclosure includes a midsection housing for an outboard motor. The midsection housing comprises a driveshaft housing having an oil sump provided therein and an adapter plate coupled to a top of the driveshaft housing, the adapter plate having an inner surface along which oil from an engine mounted on the adapter plate drains into the oil sump. First and second pockets are formed in an outer surface of the adapter plate on first and second generally opposite sides thereof. First and second mounts are located externally of the adapter plate in the first and second pockets, respectively. The first and second mounts couple the midsection housing to a transom bracket. A water jacket is formed between the inner and outer surfaces of the adapter plate. The water jacket extends at least partway between the inner surface of the adapter plate and each of the first and second pockets, respectively, so as to cool the first and second mounts located therein.

Another example of the present disclosure is of a method for cooling a mount that couples a midsection housing of an outboard motor to a transom bracket, the mount being located in a pocket cast in an outer surface of an adapter plate of the midsection housing. The method includes providing cooling water at least partway between a rear face of the pocket and an oil-wetted inner surface of the adapter plate.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
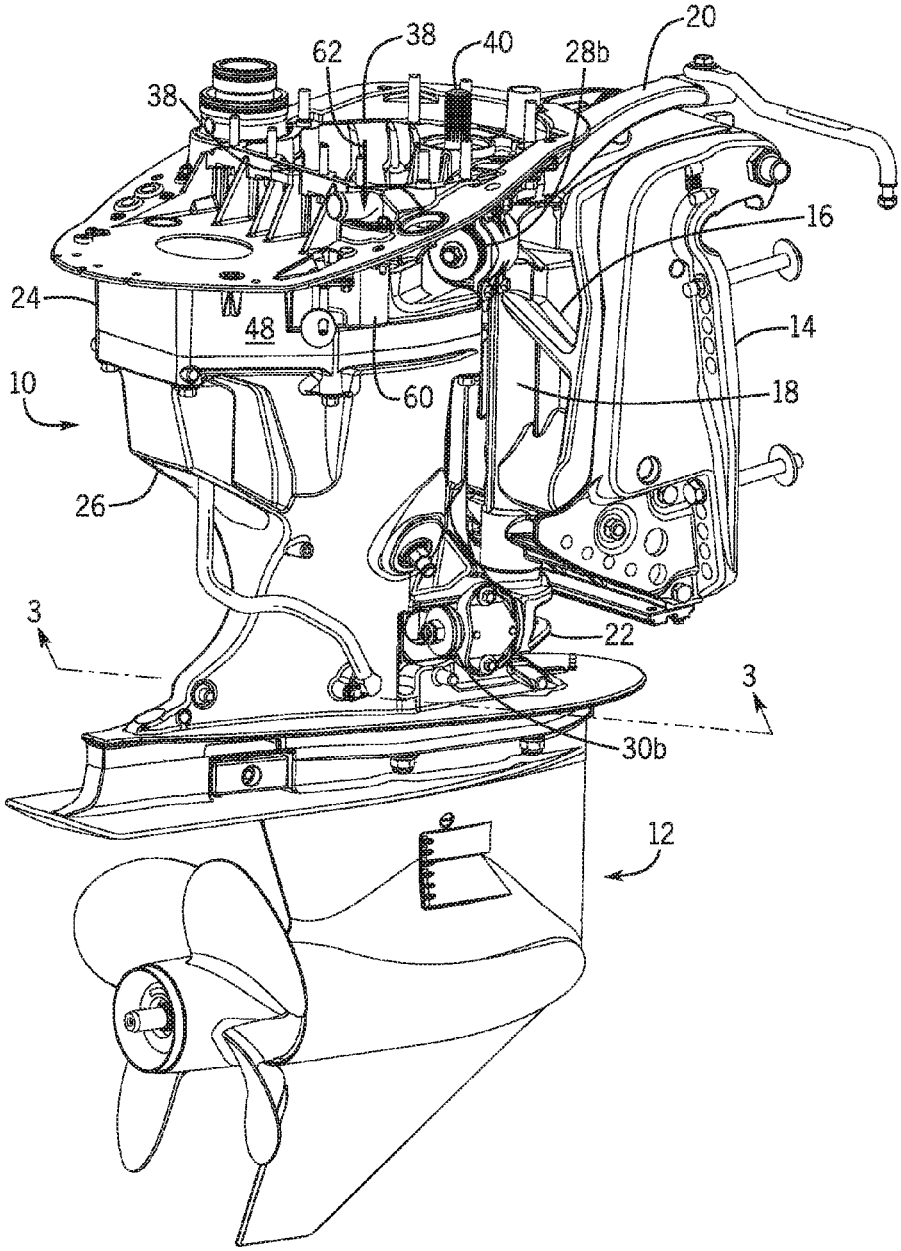
FIG. 1 illustrates a perspective view of a midsection housing for an outboard motor according to the present disclosure.

FIG. 1 illustrates a portion of an outboard motor, including a midsection housing 10 and a lower unit (gear case) 12. Although not shown herein, those having skill in the art would understand that a powerhead, including an internal combustion engine, is to be supported by and coupled to the top of the midsection housing 10. The midsection housing 10 is shown coupled to a transom bracket 14. The transom bracket 14 is configured to be mounted to a transom of a marine vessel, as is known. A swivel bracket 16 is pivotally attached to the transom bracket 14 in a conventional manner. The swivel bracket 16 has a tubular portion 18 that receives a tubular steering member (not visible). An upper end of the steering member is connected to an upper attachment bracket 20, which also comprises a steering arm. A lower end of the steering member is connected to a lower attachment bracket 22.

The upper attachment bracket 20 is coupled to an adapter plate 24 of the midsection housing 10 via first and second mounts, of which only second mount 28*b* is shown in FIG. 1. The adapter plate 24 is connected to and supports a driveshaft housing 26. Third and fourth mounts, of which fourth mount 30*b* is shown in FIG. 1, couple the lower attachment bracket 22 to the driveshaft housing 26. Further details of the mounts and their attachment to the upper and lower attachment brackets 20, 22 is provided in U.S. Pat. No. 8,820,701, which was incorporated by reference herein above. It should be understood that the '701 patent provides only one example of the type of mounts that could be used, and other examples are contemplated within the scope of the present disclosure.

Figure 2:
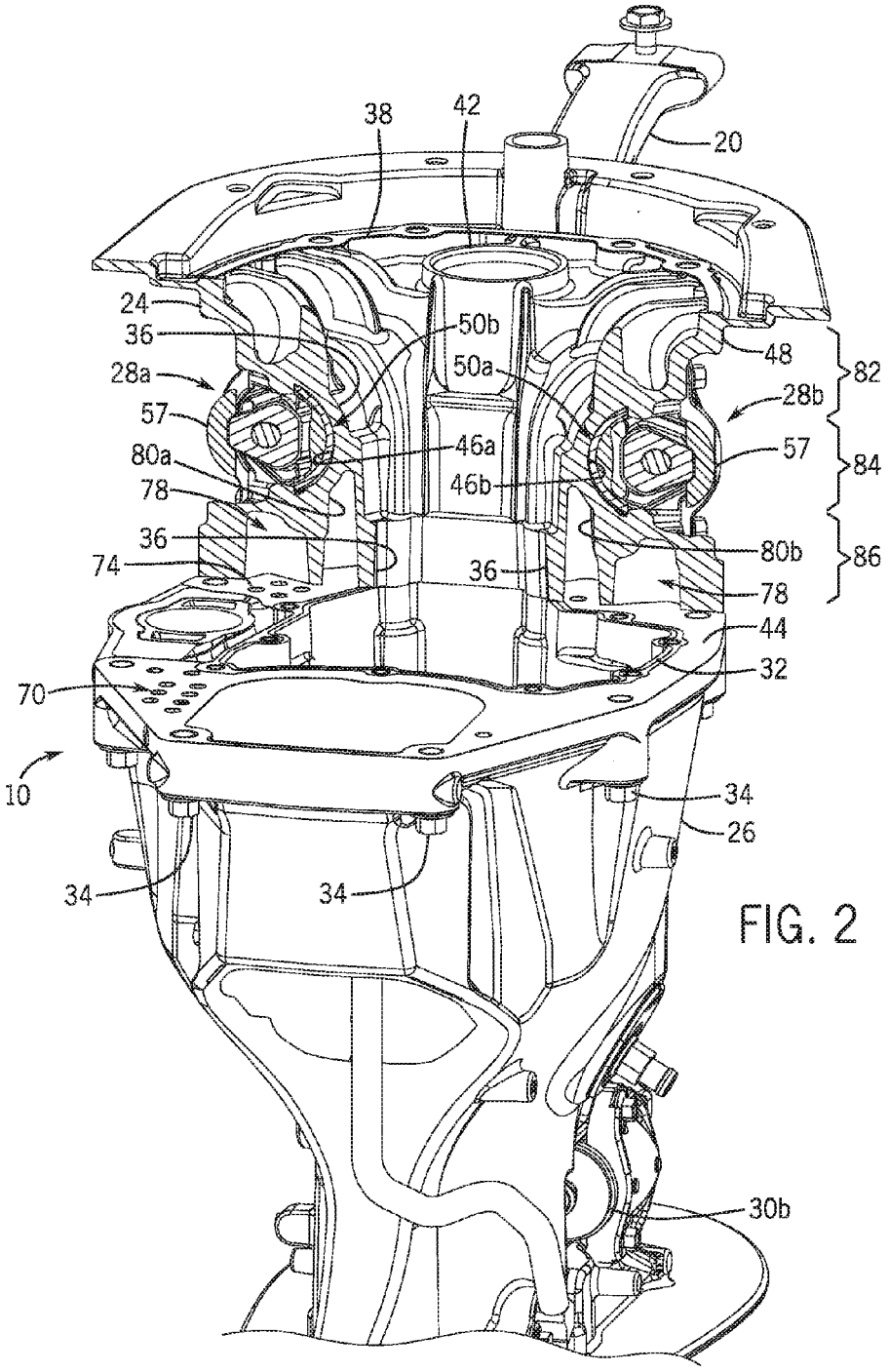
FIG. 2 illustrates a partially cross-sectioned view of the midsection housing of FIG. 1.
Figure 3:
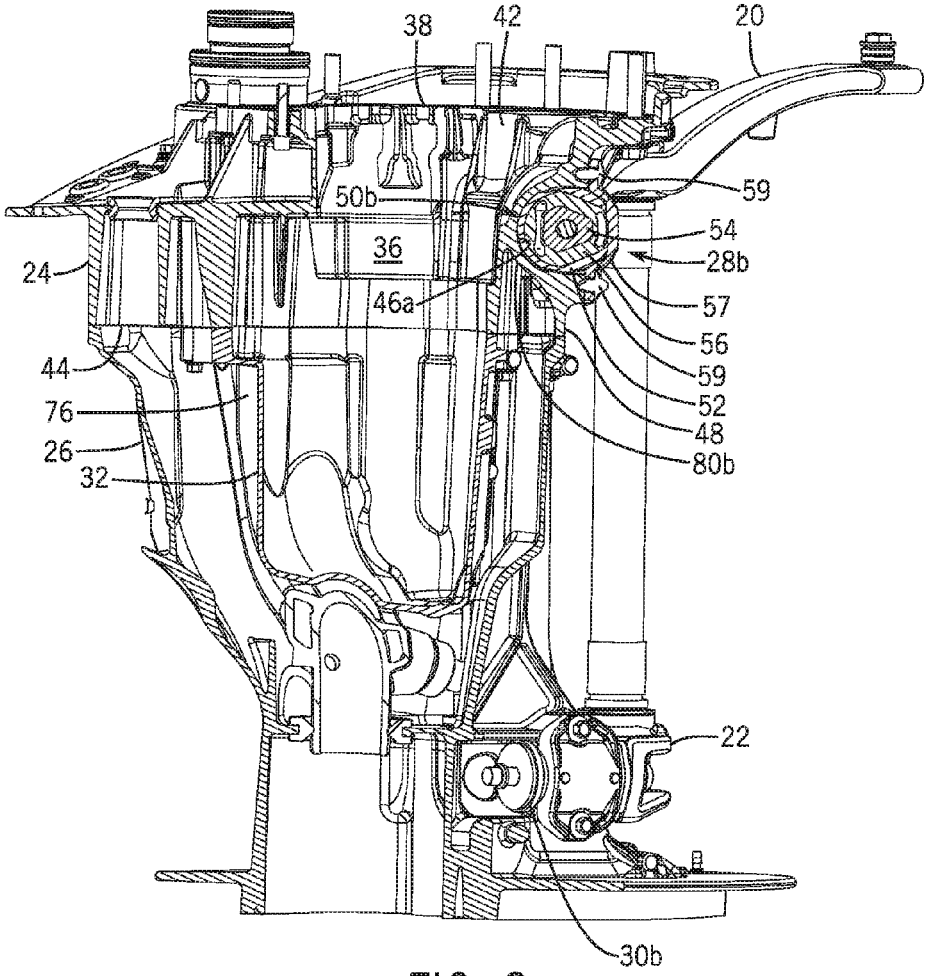
FIG. 3 illustrates a fully cross-sectioned view of the midsection housing of FIG. 1, taken along the lines 3-3.

Now turning to FIGS. 2 and 3, further details of the midsection housing 10 will be described. The midsection housing 10 comprises a driveshaft housing 26 that has an oil sump 32 provided therein. The adapter plate 24 is coupled to a top of the driveshaft housing 26, for example by way of a plurality of connectors 34 such as bolts. The adapter plate 24 has an inner surface 36 along which oil from an engine mounted on the adapter plate 24 drains into the oil sump 32. As shown, the inner surface 36 is somewhat trumpet-shaped, with the upper end of the inner surface beginning at flange 38. Although only a portion of flange 38 is shown in FIG. 2, it can be seen from FIG. 1 that the flange 38 and the inner surface 36 of the adapter plate 24 actually extend in a full, somewhat irregular polygonal shape around a generally vertical axis of the midsection housing 10. The bottom of the engine's cylinder block is to be connected directly to this flange 38, and the engine's crankshaft is to be coupled to the driveshaft 40 (see FIG. 1) of the outboard motor. A passageway 42 for the driveshaft 40 is shown in FIGS. 2 and 3.

Oil that is used to lubricate moving parts of the engine is provided to those parts by an oil pump, and is allowed to flow down over the parts and to the adapter plate 24. The oil then flows along the inner surface 36 of the adapter plate 24 and into the oil sump 32, which can be integral with the driveshaft housing 26, or a separate part provided therein. The adapter plate 24 and driveshaft housing 26 have a gasket 44 provided therebetween. The gasket 44 is shaped such that it has an inner circumference that follows the outer circumference of the oil sump 32, and therefore provides an opening that allows oil to flow into the oil sump 32. The gasket 44 mounted between the driveshaft housing 26 and the adapter plate 24 also has portions that define localized boundaries of an adapter plate water jacket, as will be described further herein below.

In order to attach the first and second mounts 28*a*, 28*b* to the adapter plate 24, first and second pockets 46*a*, 46*b* are formed in an outer surface 48 of the adapter plate 24. The first and second pockets 46*a*, 46*b* are located on first and second generally opposite sides of the adapter plate 24, and can be provided at an angle with respect to one another therein (see FIG. 4). In the example shown, the first and second pockets 46*a*, 46*b* are cast as integral portions of the outer surface 48 of the adapter plate 24. Each of the pockets 46*a*, 46*b* has a rear face 50*a*, 50*b* that is set inwardly toward the inner surface 36 of the adapter plate 24. Because the first and second pockets 46*a*, 46*b* are cast as integral portions of the outer surface 48 of the adapter plate 24, no air flow is provided between the rear faces 50*a*, 50*b* of the first and second pockets 46*a*, 46*b* and the inner surface 36 of the adapter plate 24. The first and second mounts 28*a*, 28*b* are in fact located externally of the adapter plate 24; however, because the first and second pockets 46*a*, 46*b* are configured to receive the first and second mounts 28*a*, 28*b* in intimate contact therein, this situates the mounts very close to the hot, oil-wetted inner surface 36 of the adapter plate 24. This means that the mounts 28*a*, 28*b*, can become very hot as well, and their integrity may be compromised.

In the example shown, the first and second mounts 28*a*, 28*b* each have the same configuration and components, and therefore only the mount 28*b* will be described, with the understanding that the description applies equally to mount 28*a*. Referring to FIG. 3, the mount 28*b* comprises an outer metallic shell 52 surrounding an inner metallic shell 54 and has an elastomeric spacer 56 between the outer and inner shells 52, 54. In one example, the elastomeric spacer is made of natural rubber, which provides good damping of forces exerted on the outboard motor while it is in use. A cover 57 is placed over the mount 28*a* in the pocket 46*a* and held to the outer surface 48 of the adapter plate 24 by fasteners 59. The specific makeup and configuration of the mount 28*b* is further described in U.S. Pat. No. 8,820,701, which was incorporated by reference above, and will not be described further herein. It should be understood, however, that the mounts could take a different form and include different parts than shown herein or in the '701 patent.

Through research and development, the present inventors have realized that oil at a temperature of 260-300 degrees Fahrenheit in close proximity to the mounts 28*a*, 28*b* far exceeds temperatures that can be tolerated by the elastomeric spacer 56 provided in the mount. The outer metallic shell 52 of the mount 28*b* is in intimate contact with the pocket 46*b*, and the aluminum of the adapter plate 24 and metal of the outer metallic shell 52 do little to insulate the elastomeric spacer 56 from heat. As mentioned, one example of an elastomer that can be used in the mounts is natural rubber, for which a temperature of 158 degrees Fahrenheit is preferred. If the rubber becomes marginally hotter than 158 degrees Fahrenheit it will vulcanize or harden, and will therefore not be able to damp the vibrations of the outboard motor as well. These vibrations will therefore be transferred to the transom bracket 14 and the marine vessel. If the rubber becomes too hot, it will melt and therefore will not function at all. Additionally, when rubber becomes too hot, its fatigue life can be decreased and in some cases even halved. This means that over repeated use, mounts 28*a*, 28*b* that encounter hot temperatures will need to be replaced more often than mounts that are kept at lesser temperatures. Using an elastomer that is able to encounter and withstand higher temperatures is a possibility; however, high-temperature elastomers usually have poor isolation and fatigue properties when compared to natural rubber.

Some four-stroke outboards have an exposed oil pump and an air cavity around the mounts in order to keep some heat away from the mounts. However, the air cavity lets oil pump noise out and complicates oil pump installation. Mounts can also be installed using flanges in order to isolate them from the hot, oil-wetted inner surface of the adapter plate. However, attaching the mounts using flanges is expensive, and using pockets cast directly in the outer surface 48 of the adapter plate 24 provides a much less costly alternative. Providing the mounts 28*a*, 28*b* in pockets 46*a*, 46*b* is also a much lighter option than providing separate flanges to hold the mounts.

Through research and development, the present inventors have realized that providing cooling water as far as possible between the pockets 46*a*, 46*b* and the inner surface 36 of the adapter plate 24 can help reduce the temperatures encountered by the mounts 28*a*, 28*b*, and therefore lengthen their useful life. Referring to each of FIGS. 2-4, a water jacket 58 is formed between the inner and outer surfaces 36, 48 of the adapter plate 24. Water enters the water jacket 58 via a boss 60 (FIGS. 1 and 4) that receives water that has already been used to cool the engine. Using relatively warm water that has already been used to cool the engine ensures that condensate does not form in the oil cavities. If the oil and water condensate mix, this forms a milky substance that is harmful for the engine. Water can be provided to the boss 60 from any number of cooling water jackets provided around the engine components, as shown at arrow 62 (FIG. 1). The systems and methods by which water can be provided to the engine and elsewhere to the outboard motor, and the path of water flow through the engine and elsewhere in the outboard motor, is more fully described in U.S. Pat. No. 8,500,501, which was incorporated by reference herein above. Of course, other assemblies and methods could be used to provide water to the outboard motor, and the examples provided in the '501 patent are not limiting on the scope of the present disclosure.

Figure 4:
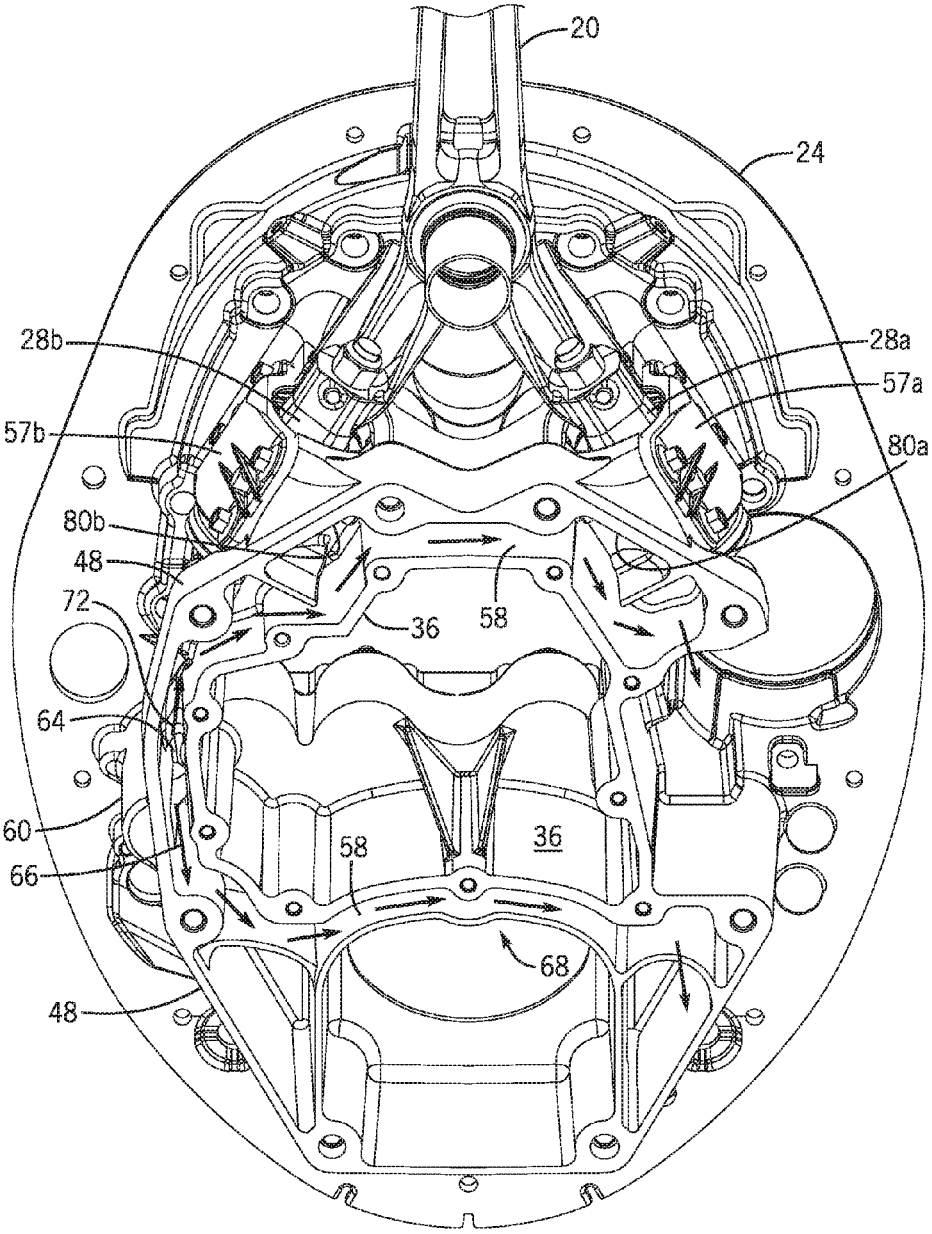
FIG. 4 illustrates a view of an underside of an adapter plate of the midsection housing of FIGS. 1-3.

As shown in FIG. 4, after water enters a passage 64 from the boss 60, it splits in two directions, toward the fore and aft of the outboard motor. Water that flows in the aft direction, as shown by the arrow 66, flows generally around an aft side 68 of the adapter plate water jacket 58 and exits downwardly via orifices 70 (FIG. 2). Water that flows in the fore direction, as shown by arrow 72, first flows toward the second mount 28*b* and then around the foremost portion of the adapter plate water jacket 58 toward the first mount 28*a*. Water thereafter exits the water jacket 58 by flowing through at least one orifice 74 provided in the gasket 44 (FIG. 2) that allows water to flow out of the water jacket 58 and into an oil sump water jacket 76 below the gasket 44 (FIG. 3).

As shown in FIGS. 2 and 3, the water jacket 58 extends at least partway between the inner surface 36 of the adapter plate 24 and each of the first and second pockets 46*a*, 46*b*. Although the water jacket 58 is situated generally below the first and second pockets 46*a*, 46*b* as shown at arrows 78, it also extends upwardly at least partway between the first and second pockets 46*a*, 46*b* and the inner surface 36 of the adapter plate 24. For example, this upward extension is provided at first and second upwardly extending recesses 80*a*, 80*b* located partway between the inner surface 36 of the adapter plate 24 and a rear face 50*a*, 50*b* of each of the first and second pockets 46*a*, 46*b*. As can be seen in the figures, each of the first and second pockets 46*a*, 46*b* is defined by a respective inwardly concave arc in the outer surface 48 of the adapter plate 24. In one example, as shown herein, the water jacket 58 in the area of recesses 80*a*, 80*b* extends upwardly along at least 25% of an arc length of each respective arc of each respective pocket 46*a*, 46*b*. The present inventors have found that this extension of the water jacket recesses 80*a*, 80*b* between the rear faces 50*a*, 50*b* of the pockets 46*a*, 46*b* and the inner surface 36 of the adapter plate 24 is enough to provide adequate cooling of the mounts 28*a*, 28*b* without negatively affecting the structural integrity of the adapter plate 24 and associated mounting system (e.g. if the adapter plate were made with too thin of inner and outer walls in order to accommodate recesses that extend higher).

Overall, referring to FIG. 2, it can be seen that the adapter plate 24 comprises an upper section 82, a middle section 84, and a lower section 86. The upper, middle, and lower sections 82, 84, 86 roughly divide the adapter plate 24, or at least a fore portion thereof, into sections that comprise roughly a third of the vertical extent of the adapter plate 24. It should be understood that the exact demarcation between each of the sections 82, 84, 86 need not be as shown herein. However, these sections are used to describe the relative positioning of different components with respect to the adapter plate 24. For example, the oil-wetted inner surface 36 begins in the upper section 82 and continues down through the middle and lower sections 84, 86 into the oil sump 32. The first and second pockets 46*a*, 46*b* are located in the middle section 84 of the adapter plate 24, and the water jacket 58 is located mostly in a lower section 86 of the adapter plate 24. However, according to the present disclosure, portions of the water jacket 58, which portions include recesses 80*a*, 80*b*, extend into the middle section 84 so as to cool the mounts 28*a*, 28*b* located therein.

Because oil is viscous, it is not very efficient at transferring heat to the adapter plate 24. This is especially true because an oil film is only driven over the inner surface 36 of the adapter plate 24 by the force of gravity, and the upper section 82 of the adapter plate 24 is not submerged in hot oil. Having a water jacket 58 and highly conductive aluminum (the material from which the adapter plate 24 is made) around the mounts 28*a*, 28*b* transfers heat away from the mounts 28*a*, 28*b* very effectively even in the adjacent mount pocket portion where the water jacket 58 does not reach. As the aluminum surface is cooled by water in the water jacket recesses 80*a*, 80*b*, the oil boundary layer on the inner surface 36 of the adapter plate 24 thickens, further increasing the temperature difference between the oil and aluminum.

A method for cooling a mount is also provided. The method is for cooling a mount that couples a midsection housing 10 of an outboard motor to a transom bracket 14, the mount 28*a*, 28*b* being located in a pocket 46*a*, 46*b* cast in an outer surface 48 of an adapter plate 24 of the midsection housing 10. The method includes providing cooling water at least partway between a rear face 50*a*, 50*b* of the pocket 46*a*, 46*b* and an oil-wetted inner surface 36 of the adapter plate 24. The method may further comprise providing the cooling water via a water jacket 58 formed between the inner and outer surfaces 36, 48 of the adapter plate 24. The method may further comprise extending the water jacket 58 as far between the rear face 50*a*, 50*b* of the pocket 46*a*, 46*b* and the inner surface 36 of the adapter plate 24 as possible without negatively affecting the structural integrity of the adapter plate 24.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies and method steps described herein may be used alone or in combination with other assemblies and methods. It is to be expected that various equivalents, alternatives and modifications are possible within the scope of the appended claims.

What is claimed is:

1. A midsection housing for an outboard motor, the midsection housing comprising:

a driveshaft housing having an oil sump provided therein;

an adapter plate coupled to a top of the driveshaft housing, the adapter plate having an inner surface along which oil from an engine mounted on the adapter plate drains into the oil sump;

first and second pockets formed in an outer surface of the adapter plate on first and second generally opposite sides thereof, wherein each of the first and second pockets is defined by a respective inwardly concave arc in the outer surface of the adapter plate and the first and second pockets are configured to receive first and second mounts therein; and a water jacket formed between the inner and outer surfaces of the adapter plate;

wherein the water jacket extends upwardly at least partway between oil-wetted portions of the inner surface of the adapter plate and each of the first and second pockets, respectively; and wherein the water jacket extends upwardly along at least 25% of an arc length of each respective arc of each of the first and second pockets.

2. The midsection housing of claim 1, wherein a remainder of the water jacket is situated generally below the first and second pockets.

3. The midsection housing of claim 1, wherein the first and second mounts are located externally of the adapter plate.

4. The midsection housing of claim 3, wherein the first and second pockets are cast as integral portions of the outer surface of the adapter plate.

5. The midsection housing of claim 4, wherein no airflow is provided between the first and second pockets and the inner surface of the adapter plate.

6. The midsection housing of claim 1, wherein water provided to the water jacket has already been used to cool the engine.

7. The midsection housing of claim 6, further comprising a gasket mounted between the driveshaft housing and the adapter plate, wherein portions of the gasket define localized boundaries of the water jacket.

8. The midsection housing of claim 7, further comprising at least one orifice in the gasket that allows water to flow into an oil sump water jacket below the gasket.

9. The midsection housing of claim 1, wherein the water jacket extends at least partway between the inner surface of the adapter plate and a rear face of each of the first and second pockets.

10. A midsection housing for an outboard motor, the midsection housing comprising:

a driveshaft housing having an oil sump provided therein;

an adapter plate coupled to a top of the driveshaft housing, the adapter plate having an inner surface along which oil from an engine mounted on the adapter plate drains into the oil sump;

first and second pockets formed in an outer surface of the adapter plate on first and second generally opposite sides thereof, wherein each of the first and second pockets is defined by a respective inwardly concave arc in the outer surface of the adapter plate;

first and second mounts located externally of the adapter plate in the first and second pockets, respectively, the first and second mounts coupling the midsection housing to a transom bracket; and a water jacket formed between the inner and outer surfaces of the adapter plate;

wherein the water jacket extends upwardly at least partway between oil-wetted portions of the inner surface of the adapter plate and each of the first and second pockets, respectively, so as to cool the first and second mounts located therein; and wherein the water jacket extends upwardly along at least 25% of an arc length of each respective arc of each of the first and second pockets.

11. The midsection housing of claim 10, wherein the first and second mounts each comprise an outer metallic shell surrounding an inner metallic shell and an elastomeric spacer between the inner and outer shells.

12. The midsection housing of claim 11, wherein the first and second pockets are cast as integral portions of the outer surface of the adapter plate.

13. The midsection housing of claim 12, wherein the outer metallic shells of the first and second mounts are in intimate contact with the first and second pockets, respectively.

14. The midsection housing of claim 10, wherein the first and second pockets are located in a middle section of the adapter plate and the water jacket is located in a lower section of the adapter plate.

15. The midsection housing of claim 14, further comprising a gasket mounted between the driveshaft housing and the adapter plate, wherein portions of the gasket define localized boundaries of the water jacket.

16. The midsection housing of claim 15, wherein the water jacket comprises first and second upwardly extending recesses located partway between the inner surface of the adapter plate and a rear face of each of the first and second pockets, respectively.

17. A method for cooling first and second mounts that couple a midsection housing of an outboard motor to a transom bracket, the first and second mounts being located in respective first and second pockets cast in an outer surface of an adapter plate of the midsection housing on generally opposite sides thereof, the method including providing cooling water via a water jacket formed between an inner surface of the adapter plate and the outer surface of the adapter plate at least partway between a rear face of each of the first and second pockets and an oil-wetted portion of the inner surface of the adapter plate;

wherein the first and second pockets are defined by respective inwardly concave arcs in the outer surface of the adapter plate, and further comprising extending the water jacket upwardly between the respective rear faces of the first and second pockets and the inner surface of the adapter plate and along at least 25% of an arc length of each respective arc of each of the first and second pockets.

* * * * *